US007307468B1

(12) United States Patent
Vasudevan

(10) Patent No.: US 7,307,468 B1
(45) Date of Patent: Dec. 11, 2007

(54) BANDGAP SYSTEM WITH TUNABLE TEMPERATURE COEFFICIENT OF THE OUTPUT VOLTAGE

(75) Inventor: Narasimhan Vasudevan, Los Angeles, CA (US)

(73) Assignee: Xilinx, Inc., San Jose, CA (US)

( * ) Notice: Subject to any disclaimer, the term of this patent is extended or adjusted under 35 U.S.C. 154(b) by 122 days.

(21) Appl. No.: 11/343,555

(22) Filed: Jan. 31, 2006

(51) Int. Cl.
*G05F 1/10* (2006.01)
*G05F 3/02* (2006.01)

(52) U.S. Cl. ..... 327/539

(58) Field of Classification Search ..... 327/539; 323/313

See application file for complete search history.

(56) References Cited

U.S. PATENT DOCUMENTS 4,810,948 A 3/1989 Takuma
5,184,061 A * 2/1993 Lee et al. ..... 323/265
5,682,352 A 10/1997 Wong et al.
5,712,590 A * 1/1998 Dries et al. ..... 327/539
5,808,576 A 9/1998 Choupek et al.
5,933,039 A 8/1999 Hui et al.
6,078,207 A 6/2000 Oguri
6,137,482 A 10/2000 Kim
6,225,992 B1 5/2001 Hsu et al.
6,229,364 B1 5/2001 Dortu et al.
6,259,293 B1 7/2001 Hayase et al.
6,404,274 B1 6/2002 Hosono et al.
6,445,238 B1 9/2002 Lesea
6,486,818 B1 11/2002 Nicholson et al.
6,914,473 B2 * 7/2005 Hohenwarter ..... 327/535
6,970,032 B1 11/2005 Smith et al.
7,088,172 B1 8/2006 Lesea et al.
7,109,783 B1 9/2006 Kondapalli et al.
2004/0130386 A1 7/2004 Liu et al.
2005/0127987 A1 * 6/2005 Sato et al. ..... 327/539

OTHER PUBLICATIONS

Xilinx, Inc.; U.S. Appl. No. 11/343,948 by Voogel et al.; filed on Jan. 31, 2006.

* cited by examiner

*Primary Examiner*—Quan Tra
(74) *Attorney, Agent, or Firm*—William L. Paradice, III; Lois D. Cartier

(57) ABSTRACT

A voltage supply circuit for generating a composite bandgap reference voltage includes a single bandgap reference voltage circuit and a select circuit. The bandgap reference circuit has a first output to generate a first bandgap voltage having a first temperature coefficient and has a second output to generate a second bandgap voltage having a second temperature coefficient that is different from the first temperature coefficient. The select circuit has a first input to receive the first bandgap voltage, a second input to receive the second bandgap voltage, and an output to selectively provide either the first bandgap voltage or the second bandgap voltage as the composite bandgap reference voltage.

16 Claims, 11 Drawing Sheets

BANDGAP SYSTEM WITH TUNABLE TEMPERATURE COEFFICIENT OF THE OUTPUT VOLTAGE

FIELD OF INVENTION

The present invention relates generally to integrated circuits, and more specifically to voltage regulation in integrated circuits.

DESCRIPTION OF RELATED ART

A configurable integrated circuit (IC) is an integrated circuit including various configurable resources. A programmable logic device (PLD) is a well-known type of configurable IC that can be programmed by a user to implement a variety of selected functions. PLDs are becoming increasingly popular with circuit designers because they require less time to design than custom-designed integrated circuits such as Application Specific Integrated Circuits (ASICs).

There are many types of PLDs such as Field Programmable Gate Arrays (FPGAs) and complex PLDs (CPLDs). For example, FIG. 1 shows a simplified block diagram of an exemplary FPGA architecture 100. FPGA 100 includes an array of configurable logic blocks (CLBs) 101*a*-101*i* and programmable input/output blocks (IOBs) 102*a*-102*d*. The CLBs 101 and IOBs 102 are selectively interconnected by a programmable interconnect structure that includes a plurality of interconnect lines 103 interconnected by a number of programmable interconnect points (PIPs) 104. The PIPs 104 are often arranged in groups (e.g., group 105) to implement multiplexer circuits that select one of several interconnect lines to provide a signal to a destination interconnect line or logic block. CLBs 101 are individually programmable and can be configured to perform a variety of logic functions on a few input signals. IOBs 102 can be configured to drive output signals from CLBs 101 to external pins (not shown for simplicity) of the FPGA and/or to receive input signals from the external FPGA pins. The CLBs 101, IOBs 102, and the general interconnect structure (e.g., PIPs 104) may be programmed by loading configuration data into associated configuration memory cells (not shown in FIG. 1 for simplicity) that control various switches, multiplexers, and other elements within the CLBs, IOBs, and the interconnect structure to implement a user circuit design embodied by the configuration data. Typically, the configuration memory cells are volatile memory cells such as SRAM cells that do not retain data when power is removed. An FPGA may include other types of configurable resources, such as multipliers, processors, transceivers, DSP blocks, clock managers, etc.

For many FPGA devices such as FPGA 100 of FIG. 1, core logic elements such as CLBs 101 are powered by a main voltage supply (VDD), I/O circuitry such as IOBs 102 are powered by a separate auxiliary voltage supply (VCCAUX), where VCCAUX is typically greater than VDD, and the configuration memory cells are powered by a regulated voltage (Vgg) that is typically generated using a well-known bandgap reference voltage. For purposes of discussion herein, VDD has a voltage of between approximately 1.0-1.2 volts, VCCAUX has a voltage of approximately 2.5 volts, and Vgg is typically regulated to approximately one transistor threshold voltage (VT) above VDD (e.g., to between approximately 1.3-1.5 volts).

For example, FIG. 2 shows a simplified portion 200 of FPGA 100 that includes a bandgap reference voltage circuit 205, a VCCAUX voltage regulator circuit 210, a plurality of configuration memory cells 230, I/O circuitry 250, and core logic 260. Voltage regulator 210, which includes a PMOS transistor 211 and an op-amp 212, generates a regulated voltage Vgg at a power node A for powering memory cells 230, which store configuration bits (CB) that may be provided to control various configurable elements within I/O circuitry 250 and core logic 260 via signal lines 231A and 231B, respectively, which are shown collectively in FIG. 2 for simplicity. PMOS transistor 211 is coupled between VCCAUX and node A, and has a well region tied to VCCAUX. Op-amp 212, which is well-known, includes a first input terminal to receive a bandgap reference voltage Vbg_ref from bandgap reference voltage circuit 205, a second input terminal coupled to node A, and an output terminal coupled to the gate of PMOS transistor 211. Bandgap reference voltage circuit 205 typically generates a value of Vbg_ref that is relatively insensitive to process and temperature variations, for example, so that configuration memory cells 230 which store logic high values of CB drive signal lines 231 with a CB signal having a voltage approximately equal to a specified value of Vgg, irrespective of the operating temperature.

FIG. 3 shows a PIP 300 that is one example of a PIP 104 of FIG. 1. PIP 300 includes an NMOS pass transistor 310 and a configuration memory cell 230. NMOS pass transistor 310 is coupled between interconnect signal lines 103A and 103B, and has a gate coupled to memory cell 230 via signal line 231. Memory cell 230 stores a CB that controls operation of NMOS pass transistor 310, and although not shown for simplicity in FIG. 2, includes a power terminal coupled to Vgg. CB is typically loaded into memory cell 230 during configuration of FPGA 100. During normal operation of FPGA 100, a logic high value of CB (e.g., CB≈Vgg) turns on transistor 310 and connects signal lines 103A-103B together, and conversely, a logic low value of CB (e.g., CB≈0 volts) turns off transistor 310 and isolates signal lines 103A-103B from each other. As mentioned above, Vgg is typically regulated to approximately one transistor VT above VDD. Because the voltage swing of logic signals on signal lines 103 is typically between 0 volts and VDD, driving the gate of NMOS transistor 310 with a logic high value that is approximately one VT greater than VDD (e.g., CB=Vgg≈VDD+VT) allows NMOS transistor 310 to pass a logic high signal without a VT drop across transistor 310.

As known in the art, the VT of pass transistor 310 is inversely related to temperature. Thus, as temperature decreases, corresponding increases in VT cause the gate voltage Vgg to become increasingly less effective for turning on transistor 310, thereby resulting in a degradation in transistor 310's performance at lower temperatures. Further, the susceptibility of a transistor 310's gate oxide (not shown for simplicity) to breakdown is exponentially proportional to operating temperature. Thus, as the operating temperature increases, the lifetime of the transistor's gate oxide layer decreases, which in turn may reduce the durability and reliability of devices such as FPGA 100 when exposed to relatively high operating temperatures. Indeed, as known in the art, a transistor's gate oxide lifetime at 100° C. may be as much as two orders of magnitude less than the transistor's gate oxide lifetime at 30° C.

Accordingly, there is a need to generate a supply voltage that may increase the lifetime of a transistor's gate oxide at relatively high temperatures while improving transistor performance at relatively low temperatures. More generally, there is a need to generate a bandgap reference voltage that may have any suitable voltage versus temperature waveform using minimal circuitry.

SUMMARY

A method and apparatus are disclosed that may generate a composite bandgap reference voltage having any desired voltage versus temperature waveform. For some embodiments, the composite bandgap reference voltage may be relatively insensitive to temperature variations when the operating temperature is within a first temperature range, and may have any suitable positive or negative temperature coefficient when the operating temperature is within a second temperature range. For other embodiments, the composite bandgap reference voltage may have a first positive or negative temperature coefficient when the operating temperature is within a first temperature range, and may have a second positive or negative temperature coefficient when the operating temperature is within a second temperature range.

In accordance with some embodiments of the present invention, a voltage supply circuit includes a single bandgap reference voltage circuit and a select circuit. The bandgap reference voltage circuit includes first and second outputs, where the first output generates a first bandgap voltage having a first voltage versus temperature relationship, and the second output generates a second bandgap voltage having a second voltage versus temperature relationship that may be independent of the first voltage versus temperature relationship. The select circuit includes inputs to receive the first and second bandgap voltages, and includes an output to selectively provide either the first bandgap voltage or the second bandgap voltage as the composite bandgap reference voltage. For one embodiment, the select circuit selects the greater of the first and second bandgap voltages to output as the composite bandgap reference voltage. For another embodiment, the select circuit selects the lesser of the first and second bandgap voltages to output as the composite bandgap reference voltage. For other embodiments, the select circuit includes a control circuit that, in response to a bandgap select signal, selects either the greater or the lesser of the first and second bandgap voltages to output as the composite bandgap reference voltage.

For some embodiments, the bandgap reference voltage circuit includes a resistor network and a switch matrix. The resistor network has a first tap to generate a first tap voltage having a positive temperature coefficient, a second tap to generate a second tap voltage that is relatively insensitive to temperature variations, and a third tap to generate a third tap voltage having a negative temperature coefficient. The switch matrix includes inputs to receive the first, second, and third tap voltages, a control terminal to receive a tap select signal, and outputs to generate the first and second bandgap voltages. For such embodiments, the switch matrix selects one of the tap voltages to provide as the first bandgap voltage and selects another of the tap voltages to provide as the second bandgap voltage in response to the tap select signal. For other embodiments, the switch matrix may be eliminated, and each of the first and second bandgap voltages may be derived directly from a corresponding tap of the resistor network.

BRIEF DESCRIPTION OF THE DRAWINGS

The features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION

For simplicity, embodiments of the present invention are described below in the context of a programmable logic device (PLD) such as an FPGA for simplicity only. It is to be understood that embodiments of the present invention are equally applicable to any suitable semiconductor device, including other user-configurable devices such as complex PLDs as well as various dedicated (e.g., non user-configurable) devices such as application-specific integrated circuits (ASICs). In some instances, well-known circuits and devices are shown in block diagram form to avoid obscuring the present invention. Further, the logic levels assigned to various signals in the description below are arbitrary, and thus can be modified (e.g., reversed polarity) as desired. Accordingly, the present invention is not to be construed as limited to specific examples described herein but rather includes within its scope all embodiments defined by the appended claims.

Figure 4:
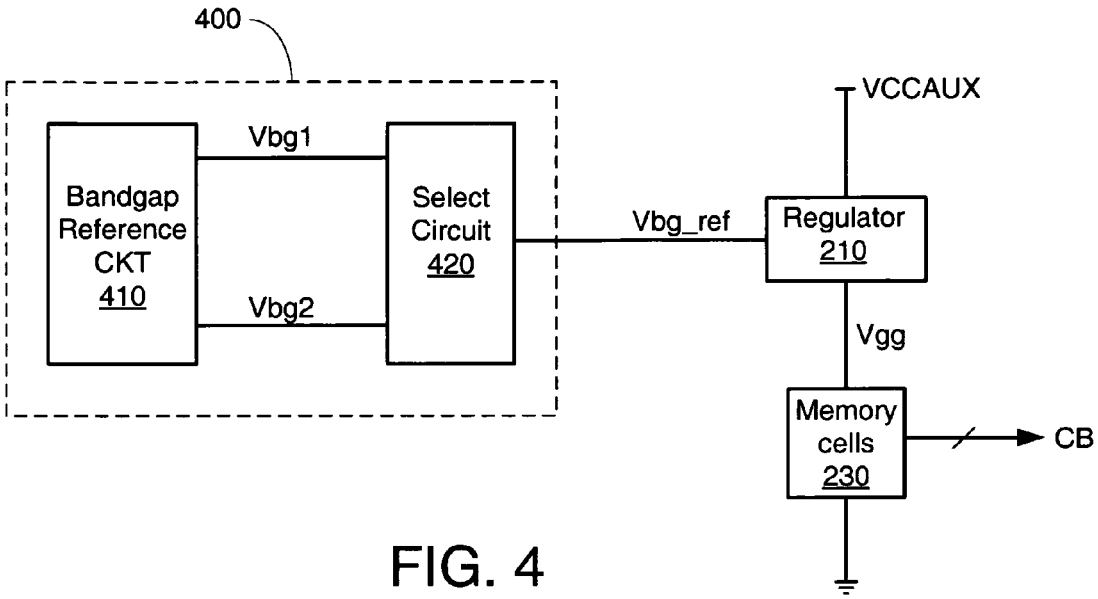
FIG. 4 is a simplified functional block diagram of a voltage supply circuit in accordance with some embodiments of the present invention.

FIG. 4 shows a functional block diagram of a voltage supply circuit 400 which, in accordance with the present invention, generates a composite bandgap reference voltage Vbg_ref that may be manipulated to have any desired voltage versus temperature waveform. Voltage supply circuit 400 is shown to include a bandgap reference voltage circuit 410 and a select circuit 420. Bandgap reference voltage circuit 410 includes a first output to generate a first bandgap voltage Vbg1, and includes a second output to generate a second bandgap voltage Vbg2 that is independent of the first bandgap voltage Vbg1. The first and second bandgap voltages may each have any suitable voltage versus temperature relationship. Thus, for example, Vbg1 may have a positive temperature coefficient, may have a negative temperature coefficient, or may be relatively insensitive to temperature variations. Similarly, Vbg2 may have a positive temperature coefficient, may have a negative temperature coefficient, or may be relatively insensitive to temperature variations.

Select circuit 420 includes inputs to receive Vbg1 and Vbg2, and includes an output to generate Vbg_ref. Select circuit 420 dynamically selects whether Vbg1 or Vb2 is provided as Vbg_ref. For some embodiments, select 420 is configured to output the greater of Vbg1 and Vbg2 as Vbg_ref. For other embodiments, select 420 is configured to output the lesser of Vbg1 and Vbg2 as Vbg_ref. For yet other embodiments, select 420 may be dynamically controlled to selectively provide either the greater or the lesser of Vbg1 and Vbg2 as Vbg_ref. In this manner, Vbg1 and Vbg2 may be alternately selected so that the resultant value of Vbg_ref provided by circuit 400 exhibits a desired voltage versus temperature waveform. For example, select circuit 420 may be configured to provide Vbg1 as Vbg_ref when the operating temperature is within a first temperature range and to provide Vbg2 as Vbg_ref when the operating temperature is within a second temperature range, thereby allowing Vbg_ref to exhibit a first voltage versus temperature relationship for the first temperature range and to exhibit a second, different voltage versus temperature relationship for the second temperature range.

The ability to generate a composite bandgap reference voltage having a first voltage versus temperature relationship for a first temperature range and having a second voltage versus temperature relationship for a second temperature range is useful when it is desired for the bandgap reference voltage to have different voltage versus temperature characteristics for different temperature ranges. Further, by generating a composite bandgap reference voltage using a single bandgap reference voltage circuit, implementation of the present embodiments requires minimal circuitry.

Figure 1:
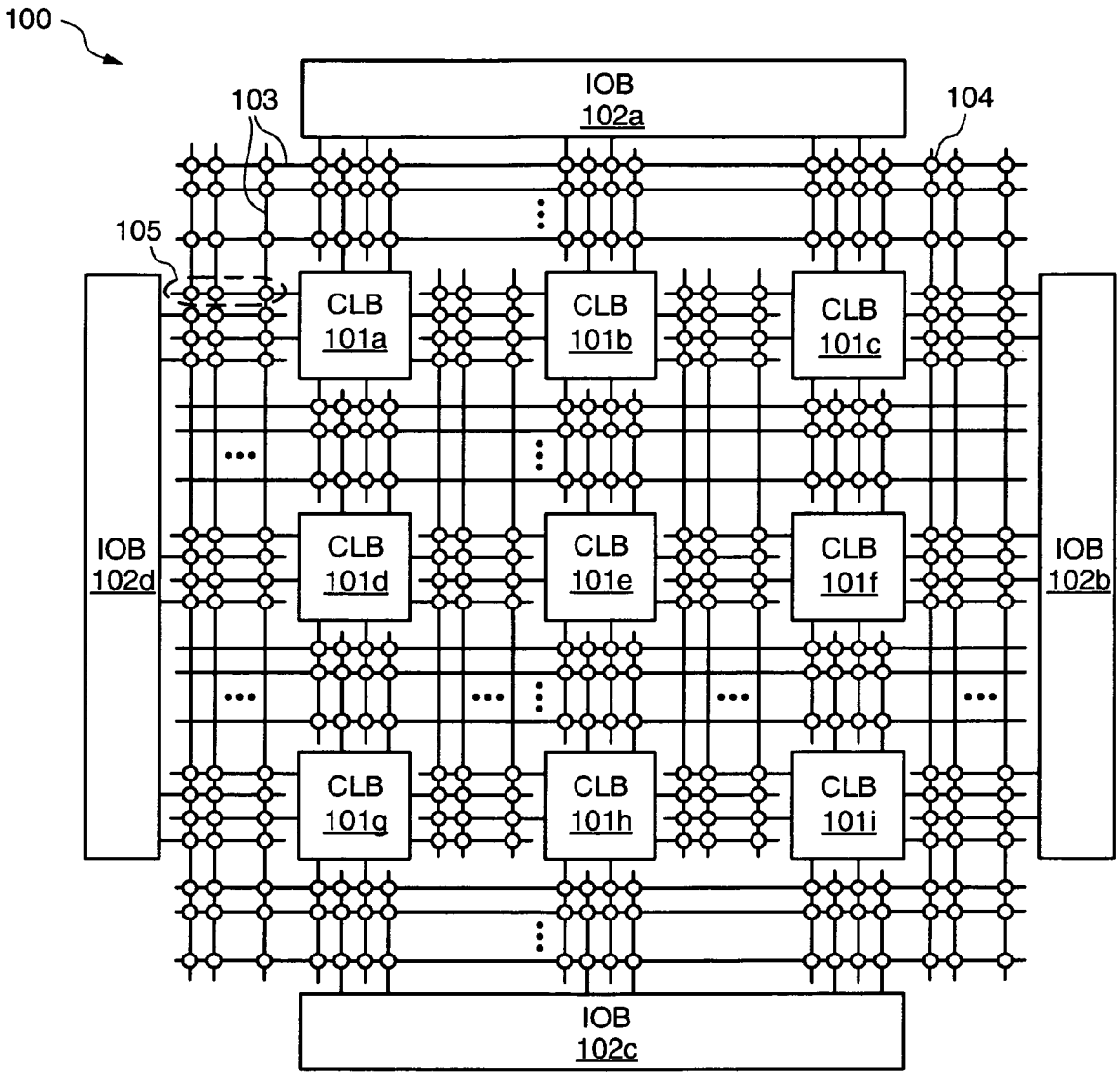
FIG. 1 (Prior Art)
FIG. 1 is a simplified block diagram of an FPGA within which some embodiments of the present embodiments may be implemented.
Figure 2:
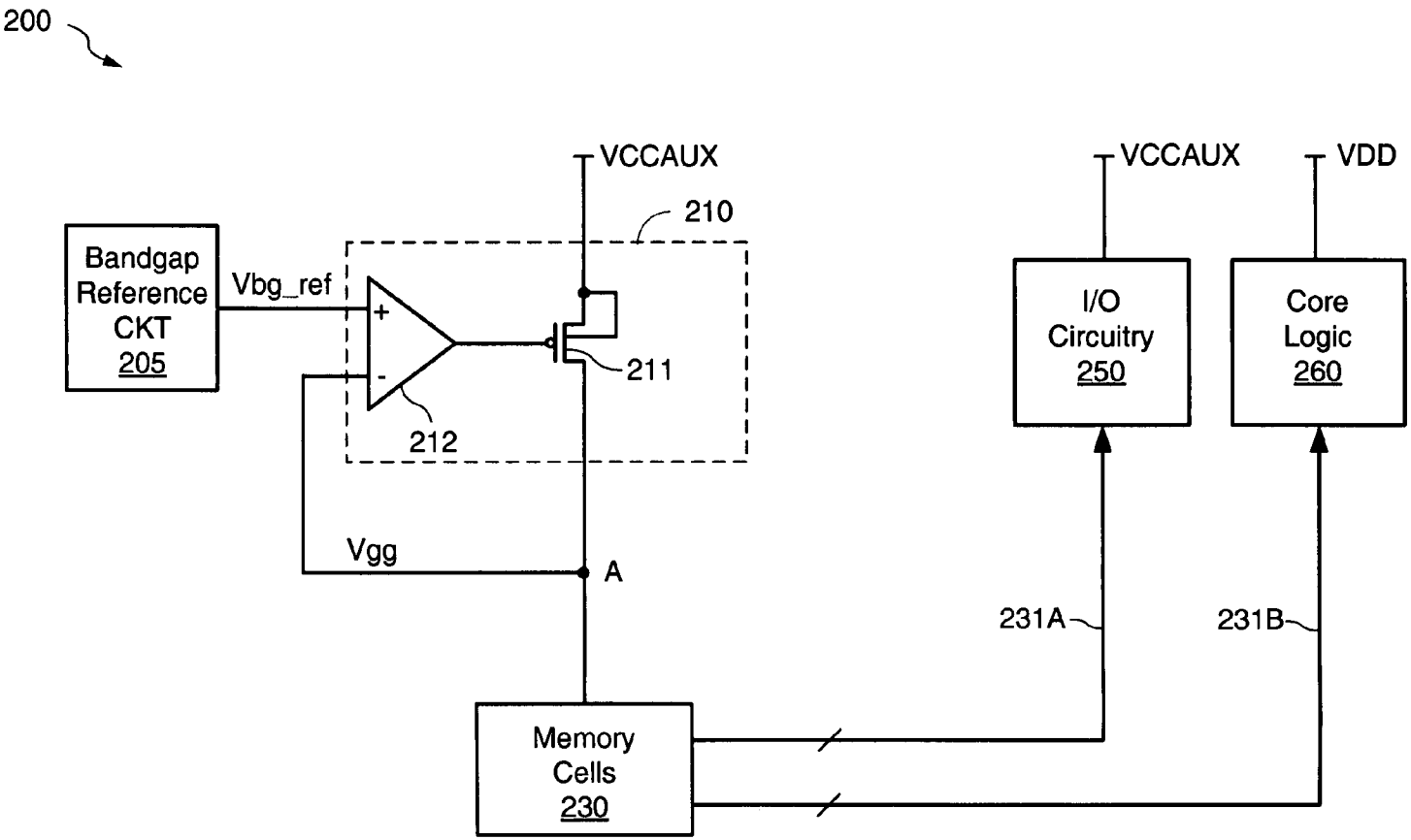
FIG. 2 (Prior Art)
FIG. 2 is a simplified function block diagram of a conventional voltage supply circuit including a bandgap reference voltage circuit and a voltage regulator circuit for powering various elements of the FPGA of FIG. 1.
Figure 3:
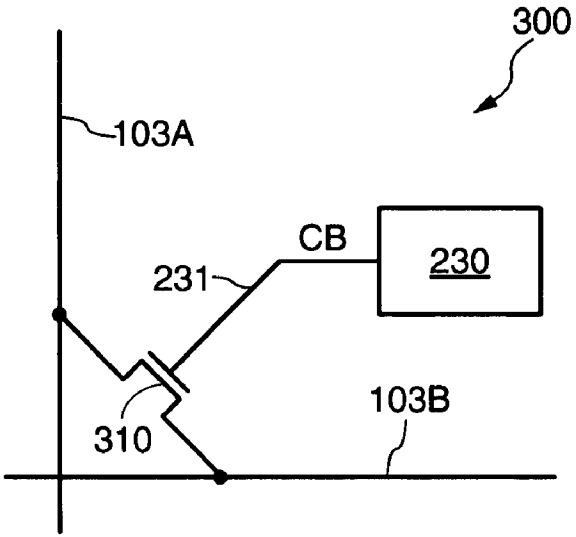
FIG. 3 (Prior Art)
FIG. 3 is a block diagram illustrating a programmable interconnect point utilized in the programmable interconnect structure of the FPGA of FIG. 1.

For the exemplary embodiment of FIG. 4, select circuit 420 is shown to provide Vbg_ref to voltage regulator 210, which as described above with respect to FIG. 2 uses Vbg_ref to provide a regulated supply voltage Vgg to configuration memory cells 230. Thus, for some embodiments, voltage supply circuit 400, which may replace circuit 205 in the FPGA of FIG. 2, may be used to generate a voltage versus temperature waveform of Vgg that prolongs transistor gate oxide lifetime at higher temperatures (e.g., by decreasing Vbg_ref at higher temperatures) while maintaining a desired transistor drive strength at lower temperatures (e.g., by increasing or maintaining Vbg_ref at a desired level at lower temperatures). However, it is to be understood that circuit 400 may be used to generate a bandgap reference voltage for any suitable integrated circuit device.

Figure 5A:
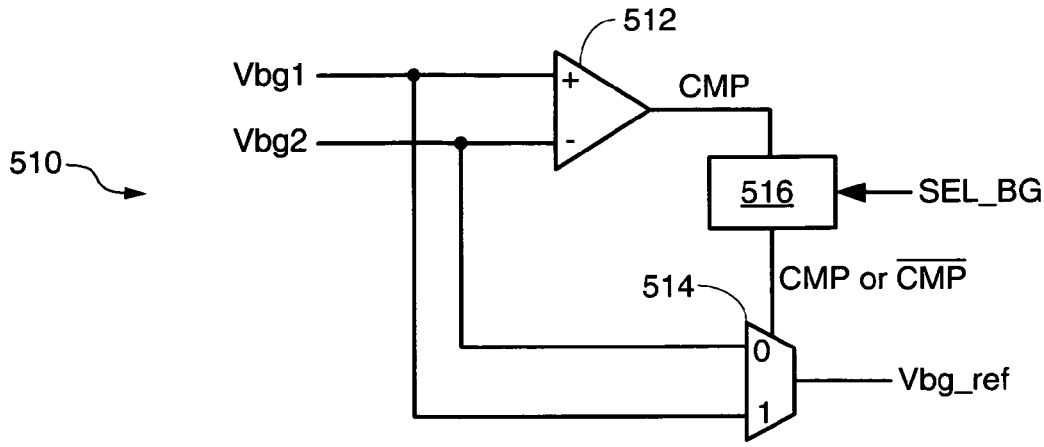
FIG. 5A is a block diagram of one embodiment of a configurable select circuit for the voltage supply circuit of FIG. 4.

FIG. 5A shows a select circuit 510 that is one embodiment of select circuit 420 of FIG. 4. Select circuit 510 includes a well-known comparator 512, a well-known multiplexer (MUX) 514, and a control circuit 516. Comparator 512 includes a positive terminal (+) to receive Vbg1, a negative terminal (−) to receive Vbg2, and an output to generate a compare signal CMP in response to a comparison between Vbg1 and Vbg2. For some embodiments, comparator 512 asserts CMP to logic "1" if Vbg1 is greater than or equal to Vbg2, and de-asserts CMP to logic "0" if Vbg1 is less than Vbg2. Control circuit 516 has an input to receive CMP, and has an output to selectively provide either CMP or its logical complement $\overline{CMP}$ to a control terminal of MUX 514 in response to a bandgap select signal SEL_BG. MUX 514 has a "1" input to receive Vbg1, a "0" input to receive Vbg2, and an output to provide Vbg_ref.

For some embodiments, SEL_BG may be stored in a suitable memory element (not shown for simplicity). For other embodiments, SEL_BG may be provided by a user via a suitable input pin (not shown for simplicity) of the device. For still other embodiments, SEL_BG may be generated by a suitable control circuit (not shown for simplicity).

In operation, when SEL_BG is driven to a first state (e.g., to logic 1), control circuit 516 provides CMP to MUX 514 so that MUX 514 outputs the greater of Vbg1 and Vbg2 as Vbg_ref. For example, when Vbg1 is greater than or equal to Vbg2, comparator 512 asserts CMP to logic 1, which is provided to the control terminal of MUX 514 by control circuit 516. In response thereto, MUX 514 outputs Vbg1 as Vbg_ref. Otherwise, when Vbg1 is less than Vbg2, comparator 512 de-asserts CMP to logic 0, which is provided to the control terminal of MUX 514 by control circuit 516. In response thereto, MUX 514 outputs Vbg2 as Vbg_ref. Conversely, when SEL_BG is driven to a second state (e.g., to logic 0), control circuit 516 provides $\overline{CMP}$ to MUX 514 so that MUX 514 outputs the lesser of Vbg1 and Vbg2 as Vbg_ref. For example, when Vbg1 is greater than or equal to Vbg2, comparator 512 asserts CMP to logic 1, which is inverted by control circuit 516 to drive the control terminal of MUX 514 to logic 0. In response thereto, MUX 514 outputs Vbg2 as Vbg_ref. Otherwise, when Vbg1 is less than Vbg2, comparator 512 de-asserts CMP to logic 0, which is inverted by control circuit 516 to drive the control terminal of MUX 514 to logic 1. In response thereto, MUX 514 outputs Vbg1 as Vbg_ref.

Figure 5B:
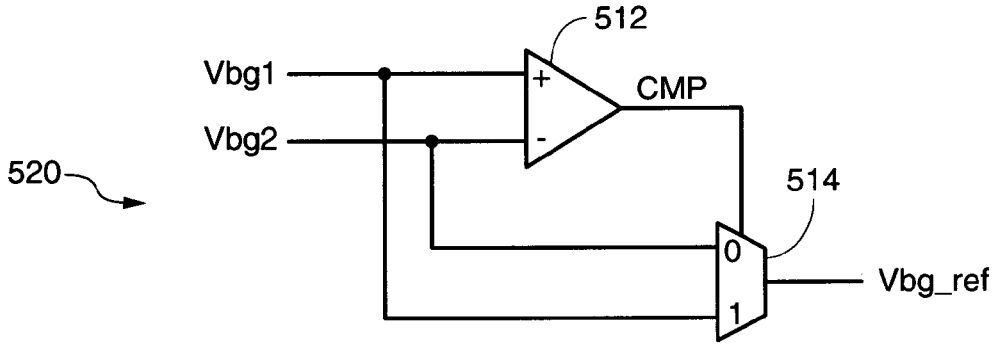
FIG. 5B is a block diagram of a first non-configurable select circuit for the voltage supply circuit of FIG. 4.

For other embodiments, the select circuit may be hardwired to provide the greater of Vbg1 and Vbg2 as Vbg_ref. For example, FIG. 5B shows a select circuit 520 that is another embodiment of select circuit 420 of FIG. 4. Select circuit 520 includes comparator 512 and MUX 514. Comparator 512 includes a positive terminal (+) to receive Vbg1, a negative terminal (−) to receive Vbg2, and an output to generate CMP. MUX 514 has a "1" input to receive $Vbg_1$, a "0" input to receive Vbg2, a control terminal to receive CMP, and an output to provide Vbg_ref. When Vbg1 is greater than or equal to Vbg2, comparator 512 asserts CMP to logic 1, which causes MUX 514 to output Vbg1 as Vbg_ref. Conversely, when Vbg1 is less than Vbg2, comparator 512 de-asserts CMP to logic 0, which causes MUX 514 to output Vbg2 as Vbg_ref.

Figure 5C:
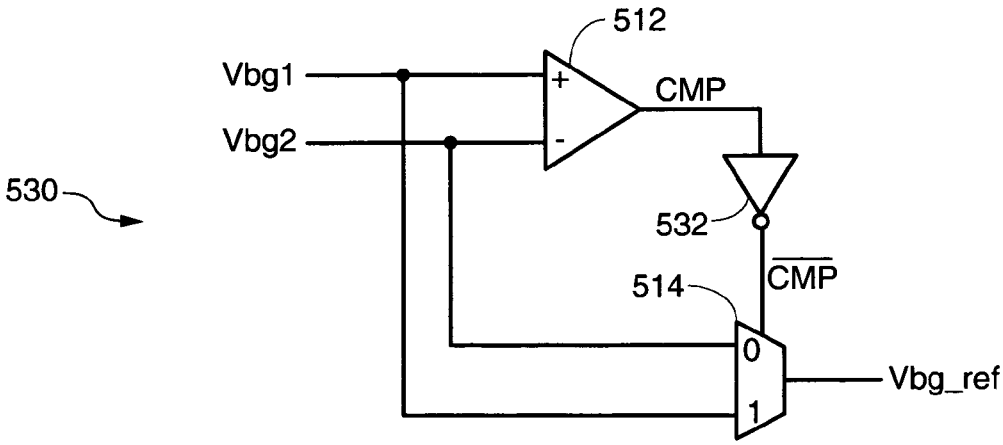
FIG. 5C is a block diagram of a second non-configurable select circuit for the voltage supply circuit of FIG. 4.

For still other embodiments, the select circuit may be configured to output the lesser of Vbg1 and Vbg2 as Vbg_ref. For example, FIG. 5C shows a select circuit 530 that is another embodiment of select circuit 420 of FIG. 4. Select circuit 530 includes comparator 512, MUX 514, and a well-known logical inverter 532. Comparator 512 includes a positive terminal (+) to receive Vbg1, a negative terminal (−) to receive Vbg2, and an output to generate CMP. MUX 514 has a "1" input to receive Vbg1, a "0" input to receive Vbg2, a control terminal to receive the complement ($\overline{CMP}$) of CMP via inverter 532, and an output to provide Vbg_ref. When Vbg1 is greater than or equal to Vbg2, comparator 512 asserts CMP to logic 1, which is logically complemented by inverter 532 to generate a logic low value of $\overline{CMP}$ that causes MUX 514 to output Vbg2 as Vbg_ref. Conversely, when Vbg1 is less than Vbg2, comparator 512 de-asserts CMP to logic 0, which is logically complemented by inverter 532 to generate a logic high value of $\overline{CMP}$ that causes MUX 514 to output Vbg1 as Vbg_ref. Alternatively, inverter 532 may be eliminated, and Vbg1 may be provided to the "0" input of MUX 514 and Vbg2 may be provided to the 1 input of MUX 514.

Figure 6:
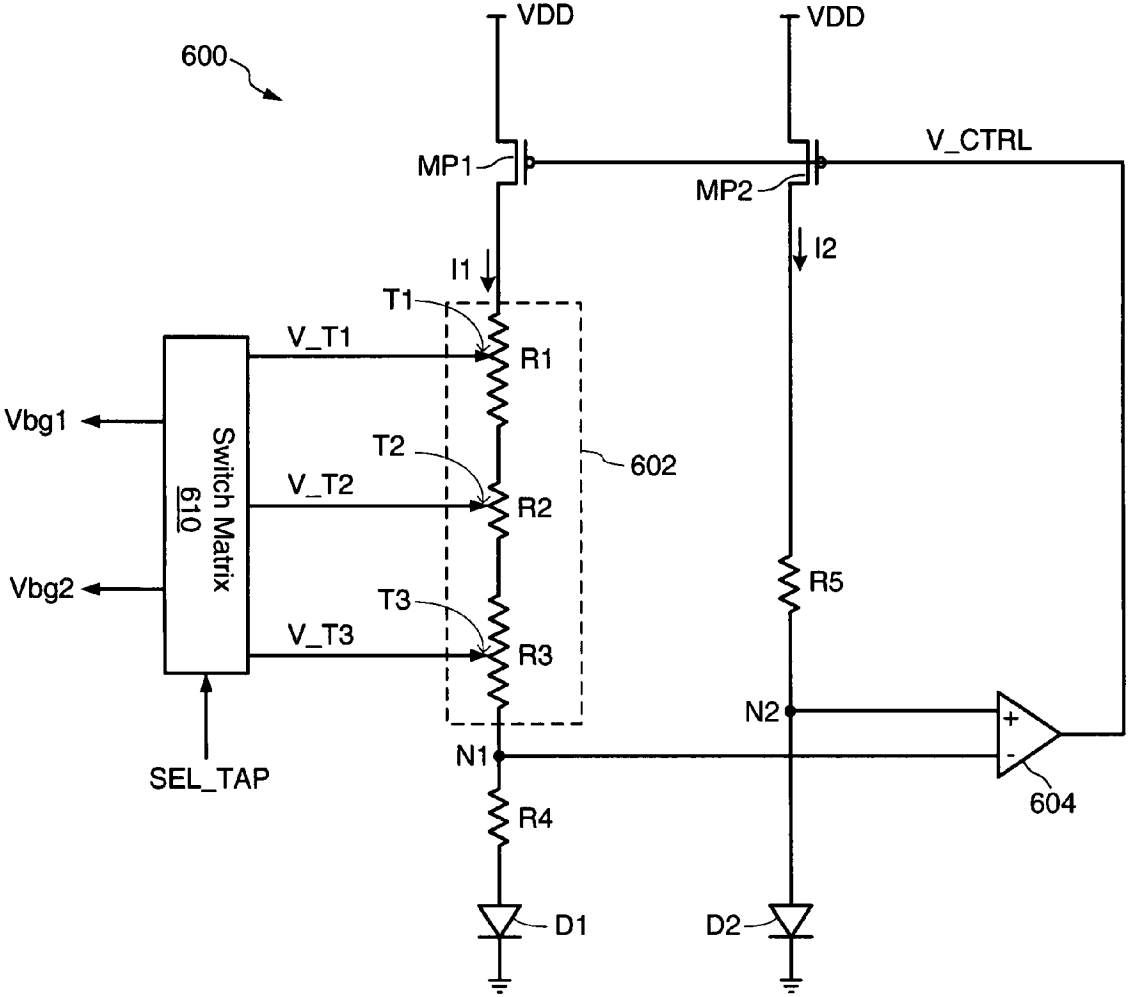
FIG. 6 is a circuit diagram of one embodiment of the bandgap reference voltage circuit of FIG. 4.

FIG. 6 shows a bandgap reference voltage circuit 600 that is one embodiment of bandgap reference voltage circuit 410 of FIG. 4. Bandgap reference voltage circuit 600 includes PMOS transistors MP1-MP2, resistors R1-R5, diodes D1-D2, an op-amp 604, and a switch matrix 610. PMOS transistor MP1 and a resistor network 602 formed by a series connection of resistors R1-R3 are connected in series between a supply voltage VDD and node N1, with a first terminal of resistor network 602 coupled to PMOS transistor MP1 and a second terminal of resistor network 602 coupled to node N1. Resistor network 602 includes three tap points T1-T3, where the first tap point T1 generates a first tap voltage V_T1 via resistor R1, the second tap point T2 generates a second tap voltage V_T2 via resistor R2, and the third tap point T3 generates a third tap voltage V_T3 via resistor R3. Resistor R4 and diode D1 are connected in series between node N1 and ground potential. PMOS transistor MP2 and resistor R5 are connected in series between VDD and node N2. Diode D2 is connected in series between node N2 and ground potential. Op-amp 604, which is well-known, includes an inverting terminal coupled to node N1, a non-inverting input terminal coupled to node N2, and an output terminal coupled to the gates of PMOS transistors MP1 and MP2. Diodes D1-D2 are well-known. For some embodiments, diodes D1-D2 may be diode-connected bipolar transistors. For other embodiments, diodes D1-D2 may be implemented using other well-known techniques.

The voltage drops across resistor network 602, resistor R4, and resistor R5 are directly proportional to temperature, and the voltage drops across diodes D1-D2 are inversely proportional to temperature. In this manner, the voltage drops across resistors R1-R5 have a positive temperature coefficient, and the voltage drops across diodes D1-D2 have a negative temperature coefficient.

Switch matrix 610 includes a first input to receive V_T1 from tap T1, a second input to receive V_T2 from tap T2, a third input to receive V_T3 from tap T3, a first output to provide Vbg1, a second output to provide Vbg2, and a control terminal to receive a tap voltage select signal (SEL_TAP). Switch matrix 610, which may be implemented using well-known circuitry, selectively provides one of V_T1, V_T2, and V_T3 as Vbg1 and provides another of V_T1, V_T2, and V_T3 as Vbg2 in response to SEL_TAP. For one embodiment, SEL_TAP may be stored in a suitable memory element (not shown for simplicity). For another embodiment, SEL_TAP may be provided by a user via a suitable input pin (not shown for simplicity) of the device. For yet another embodiment, SEL_TAP may be generated by a suitable control circuit (not shown for simplicity).

For other embodiments, switch matrix 610 may be eliminated, and Vbg1 may be taken directly from one of resistor taps T1-T3 and Vbg2 may be taken directly from another of resistor taps T1-T3.

In operation, PMOS transistor MP1 provides a current I1 to node N1 via resistor network 602, and PMOS transistor MP2 provides a current I2 to node N2 via resistor R5, thereby generating a voltage differential between nodes N1 and N2. Diode D1 sinks a first bias current from node N1 through resistor R4 to ground potential, and diode D2 sinks a second bias current from node N2 to ground potential Op-amp 604 adjusts the voltage of V_CTRL, which is provided as the gate voltage to PMOS transistors MP1-MP2, to adjust the currents I1 and I2 to minimize the voltage differential between the op-amp inputs at N1 and N2. If the voltages at nodes N1 and N2 are equal, then the voltage drop across resistor R4 is equal to the difference between the voltage drops across diodes D1 and D2 (e.g., V_R4=V_D2−V_D1). Further, the voltage at any tap point in the resistor network 602 is determined by the voltage drops across diode D1, resistor R4, and one or more corresponding resistors R1-R3. For example, the tap voltage V_T3 is determined by the voltage drops across diode D1 and resistors R3-R4, the tap voltage V_T2 is determined by the voltage drops across diode D1 and resistors R2-R4, and the tap voltage V_T1 is determined by the voltage drops across diode D1 and resistors R1-R4.

As mentioned above, the voltage drops across resistors R1-R4 have positive temperature coefficients, and the voltage drop across diode D1 has a negative temperature coefficient. Thus, in accordance with the present invention, resistors R1-R3 are fabricated to have corresponding appropriate resistive values such that the first tap voltage V_T1 at first tap point T1 has a positive temperature coefficient, the second tap voltage V_T2 at second tap point T2 is relatively insensitive to temperature variations, and the third tap voltage V_T3 at third tap point T3 has a negative temperature coefficient. Resistors R1-R3, resistors R4-R5, and diodes D1-D2 may be fabricated in a well-known manner to generate tap voltages $V_T_1$ to V_T3 that have desired voltage versus temperature characteristics.

Figure 7A:
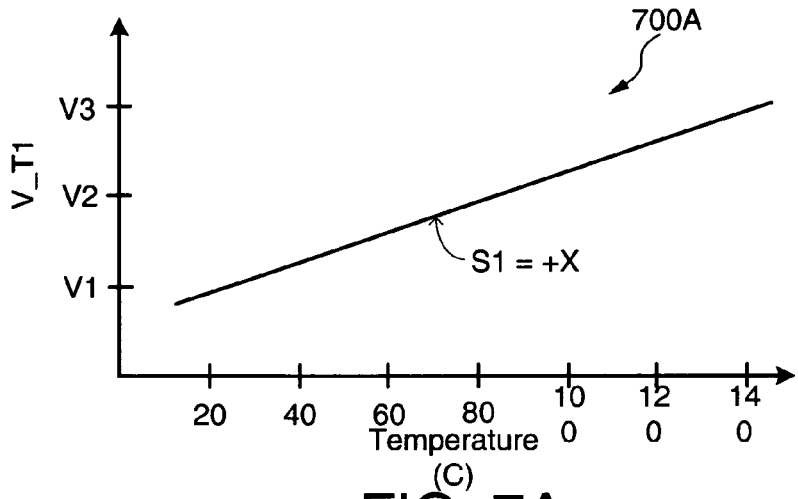
FIG. 7A is an exemplary voltage vs. temperature plot for a first tap voltage provided from a first resistor tap of the bandgap reference voltage circuit of FIG. 6.
Figure 7B:
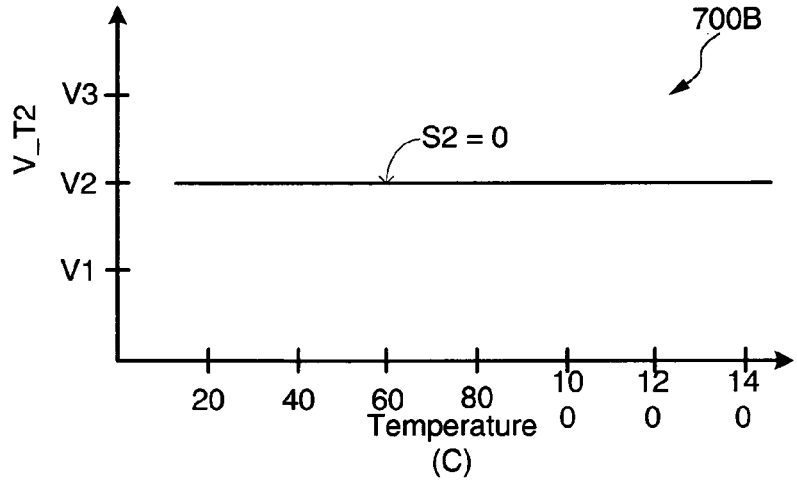
FIG. 7B is an exemplary voltage vs. temperature plot for a second tap voltage provided from a second resistor tap of the bandgap reference voltage circuit of FIG. 6.
Figure 7C:
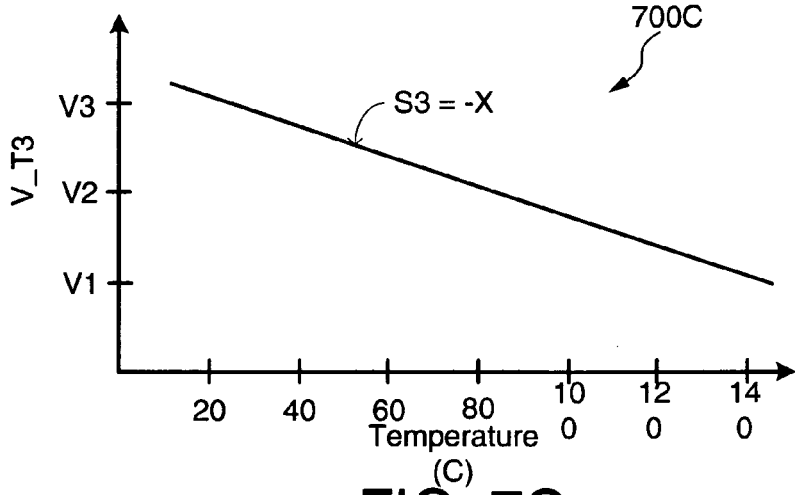
FIG. 7C is an exemplary voltage vs. temperature plot for a third tap voltage provided from a third resistor tap of the bandgap reference voltage circuit of FIG. 6.

For example, FIG. 7A illustrates an exemplary voltage vs. temperature plot 700A of V_T1 as having a positive voltage/temperature slope S1=+X so that the voltage of V_T1 increases in response to increases in operating temperature according to the slope value X≈(V3−V1)/(140-25), where V3 and V1 are arbitrary voltages. For the exemplary plot depicted in FIG. 7A, the value of V_T1 at 85° C. is approximately equal to V2. FIG. 7B illustrates an exemplary voltage vs. temperature plot 700B of V_T2 as having a flat voltage/temperature slope S2=0 so that the voltage of V_T2 remains substantially constant (e.g., relatively temperature insensitive) at approximately V2 at all temperatures, where V2 is an arbitrary voltage. FIG. 7C illustrates an exemplary voltage vs. temperature plot 700C of V_T3 as having a negative voltage/temperature slope S3=−X so that the voltage of V_T3 decreases in response to increases in operating temperature according to the slope value X≈(V3−V1)/(25-140). For the exemplary plot depicted in FIG. 7C, the value of V_T2 at 85° C. is approximately equal to V2.

Referring again to FIGS. 4, 5A, and 6, bandgap reference voltage circuit 600 may be configured to output either V_T1, V_T2, or V_T3 as Vbg1 and to output either V_T1, V_T2, or V_T3 as Vbg2, and the select circuit may be configured to output either the greater of Vbg1 and Vbg2 or the lesser of Vbg1 and Vbg2 as Vbg_ref. In this manner, bandgap reference voltage circuit 600 and select circuit 510 may be collectively configured to generate any suitable voltage versus temperature waveform for Vbg_ref, as described in the examples below.

For first embodiments, bandgap reference voltage circuit 600 may be configured to provide V_T1 as Vbg1 and to provide V_T2 as Vbg2, for example, by driving SEL_TAP to a first state. For such embodiments, if the select circuit is configured to output the greater of Vbg1 and Vbg2 as Vbg_ref, then Vbg_ref has a voltage versus temperature waveform similar to that depicted by the solid line in the exemplary plot 800A of FIG. 8A. In this manner, Vbg_ref is maintained at substantially constant voltage for operating temperatures less than a trigger temperature (e.g., which is approximately 85° C. for exemplary embodiments described herein), and as the operating temperature exceeds the trigger temperature, Vbg_ref begins to increase in response to further temperature increases at a rate equal to approximately X (V/° C.). Thus, for the waveform of FIG. 8A, Vbg_ref is relatively temperature insensitive at temperatures below approximately 85° C., and exhibits a positive temperature coefficient of X at temperatures above approximately 85° C.

Figure 8B:
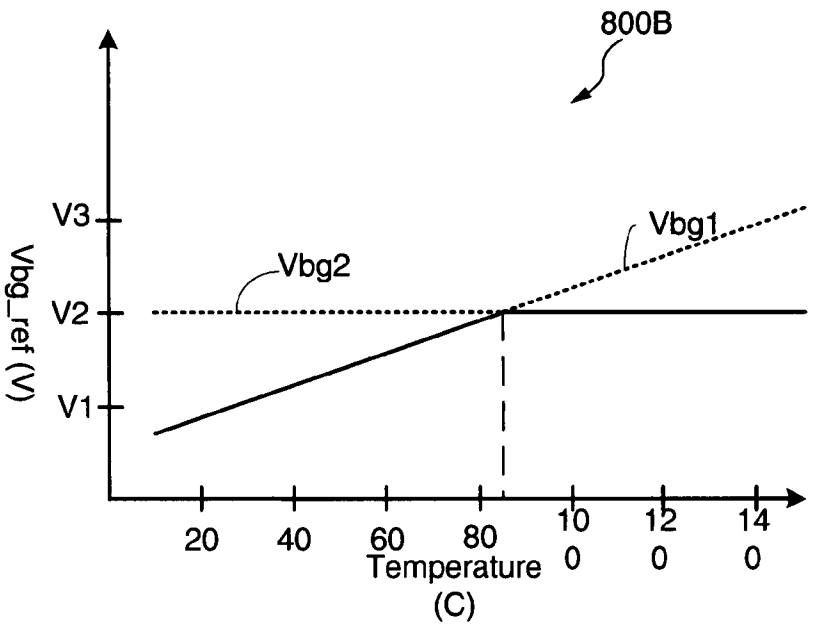
FIG. 8B is an exemplary voltage vs. temperature plot for the composite bandgap reference voltage for a second configuration state.
Figure 8A:
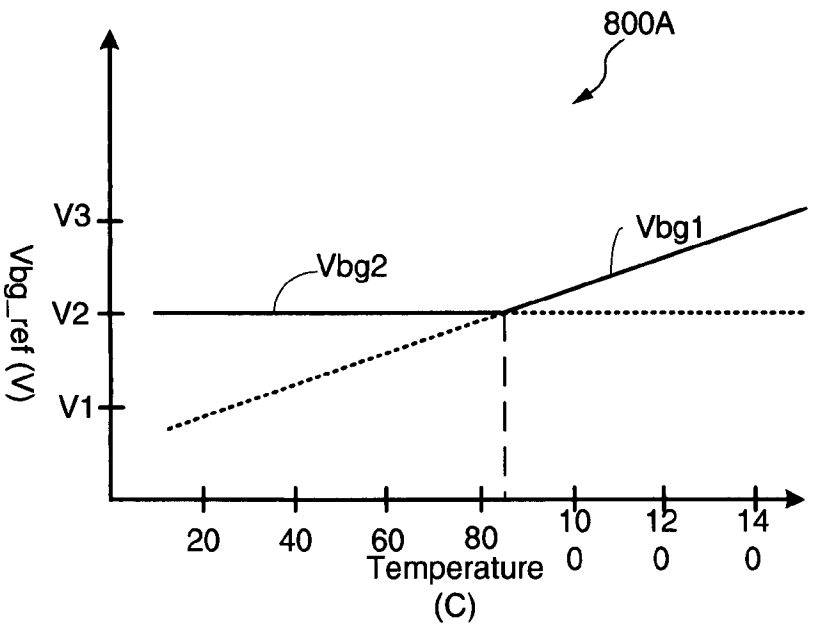
FIG. 8A is an exemplary voltage vs. temperature plot for the composite bandgap reference voltage for a first configuration state.

Conversely, if the select circuit is configured to output the lesser of Vbg1 and Vbg2 as Vbg_ref, then Vbg_ref has a voltage versus temperature waveform similar to that depicted by the solid line in the exemplary plot 800B of FIG. 8B. In this manner, the voltage of Vbg_ref increases in response to temperature increases at a rate of approximately X (V/° C.) until the operating temperature reaches the trigger temperature, above which Vbg_ref is maintained at substantially constant voltage. Thus, for the waveform of FIG. 8B, Vbg_ref exhibits a positive temperature coefficient of X at temperatures below approximately 85° C., and is relatively temperature insensitive at temperatures above approximately 85° C.

For second embodiments, bandgap reference circuit 600 may be configured to provide V_T2 as Vbg1 and to provide V_T3 as Vbg2, for example, by driving SEL_TAP to a second state. For such embodiments, if the select circuit is configured to output the greater of Vbg1 and Vbg2 as Vbg_ref, then Vbg_ref has a voltage versus temperature waveform similar to that depicted by the solid line in the exemplary plot 800C of FIG. 8C. In this manner, the voltage of Vbg_ref decreases in response to temperature increases at a rate of approximately −X (V/° C.) until the operating temperature reaches the trigger temperature, above which Vbg_ref is maintained at substantially constant voltage. Thus, for the waveform of FIG. 8C, Vbg_ref exhibits a negative temperature coefficient of −X at temperatures below approximately 85° C., and is relatively insensitive to temperatures above approximately 85° C.

Figure 8D:
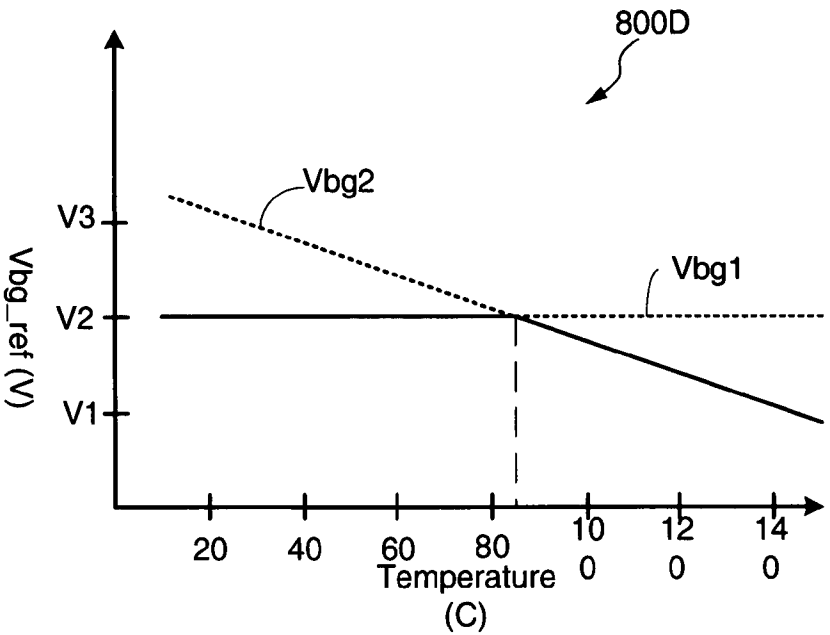
FIG. 8D is an exemplary voltage vs. temperature plot for the composite bandgap reference voltage for a fourth configuration state.
Figure 8C:
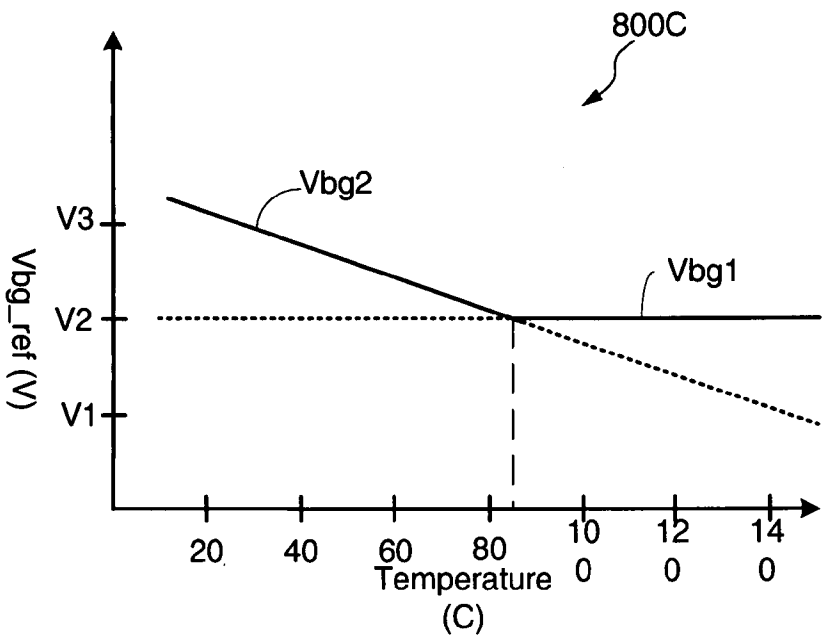
FIG. 8C is an exemplary voltage vs. temperature plot for the composite bandgap reference voltage for a third configuration state.

Conversely, if the select circuit is configured to output the lesser of Vbg1 and Vbg2 as Vbg_ref, then Vbg_ref has a voltage versus temperature waveform similar to that depicted by the solid line in the exemplary plot 800D of FIG. 8D. In this manner, Vbg_ref is maintained at substantially constant voltage for operating temperatures less than the trigger temperature, and as the operating temperature exceeds the trigger temperature, Vbg_ref begins to decrease in response to further temperature increases at a rate equal to approximately −X (V/° C.). Thus, for the waveform of FIG. 8D, Vbg_ref is relatively temperature insensitive at temperatures below approximately 85° C., and exhibits a negative temperature coefficient of −X at temperatures above approximately 85° C.

For third embodiments, bandgap reference circuit 600 may be configured to provide V_T1 as Vbg1 and to provide V_T3 as Vbg2, for example, by driving SEL_TAP to a third state. For such embodiments, if the select circuit is configured to output the greater of Vbg1 and Vbg2 as Vbg_ref, then Vbg_ref has a voltage versus temperature waveform similar to that depicted by the solid line in the exemplary plot 800E of FIG. 8E. In this manner, the voltage of Vbg_ref decreases in response to temperature increases at a rate of approximately −X (V/° C.) until the operating temperature reaches the trigger temperature, above which Vbg_ref increases in response to temperature increases at a rate of approximately X (V/° C.). Thus, for the waveform of FIG. 8E, Vbg_ref exhibits a negative temperature coefficient of −X at temperatures below approximately 85° C., and exhibits a positive temperature coefficient of X at temperatures above approximately 85° C.

Figure 8F:
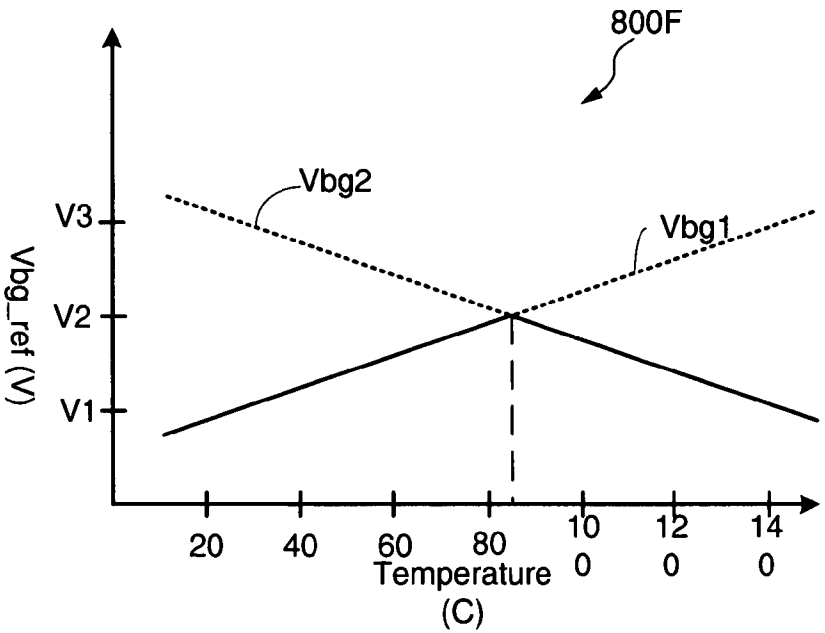
FIG. 8F is an exemplary voltage vs. temperature plot for the composite bandgap reference voltage for a sixth configuration state.
Figure 8E:
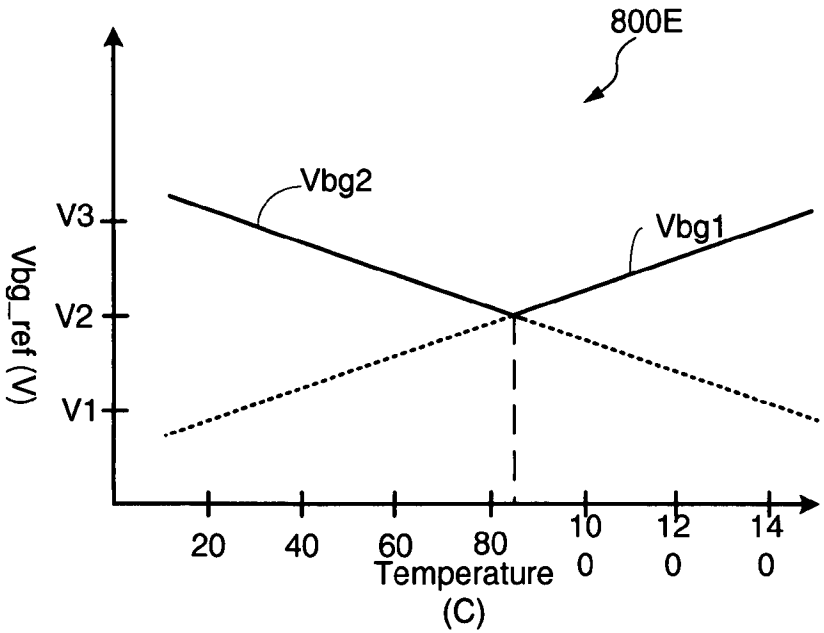
FIG. 8E is an exemplary voltage vs. temperature plot for the composite bandgap reference voltage for a fifth configuration state.

Conversely, if the select circuit is configured to output the lesser of Vbg1 and Vbg2 as Vbg_ref, then Vbg_ref has a voltage versus temperature waveform similar to that depicted by the solid line in the exemplary plot 800F of FIG. 8F. In this manner, the voltage of Vbg_ref increases in response to temperature increases at a rate of approximately X (V/° C.) until the operating temperature reaches approximately 85° C., above which Vbg_ref decreases in response to temperature increases at a rate of approximately −X (V/° C.). Thus, for waveform of FIG. 8F, Vbg_ref exhibits a positive temperature coefficient of X at temperatures below approximately 85° C., and exhibits a negative temperature coefficient of −X at temperatures above approximately 85° C.

Thus, as described above, embodiments of the present invention allow a single bandgap reference voltage circuit to generate a composite bandgap reference voltage Vbg_ref having any suitable voltage versus temperature relationship, for example, such as the exemplary Vbg_ref waveforms depicted in FIGS. 8A-8E. This allows a customer to select a desired voltage versus temperature Vbg_ref waveform depending upon desired circuit and/or operating conditions. For example, configuring the bandgap reference voltage circuit and the select circuit to generate the Vbg_ref waveform depicted in FIG. 8D may increase transistor gate oxide lifetime by reducing Vbg_ref in response to temperature increases beyond the trigger temperature while maintaining a constant transistor drive strength at temperatures below the trigger temperature by maintaining Vbg_ref at a substantially constant value at temperatures below the trigger temperature.

Figure 9:
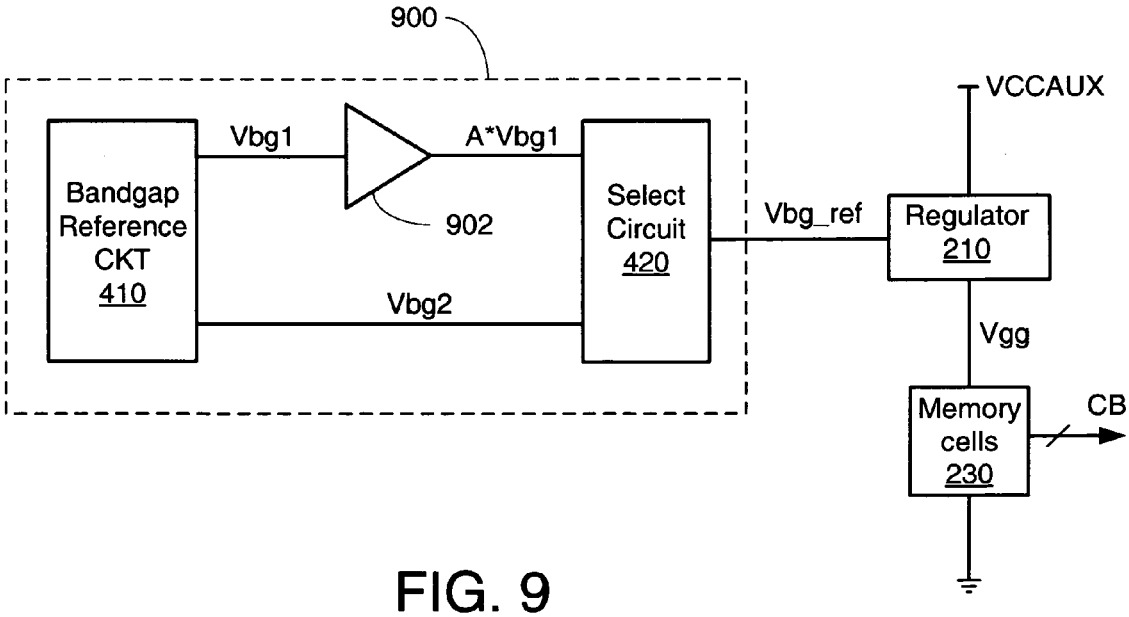
FIG. 9 is a simplified functional block diagram of a voltage supply circuit in accordance with other embodiments of the present invention.

The trigger temperature at which various embodiments of the select circuits described above switch between Vbg1 and Vbg2 for output as Vbg_ref may be adjusted by manipulating the gain of either Vbg1 and/or Vbg2. For example, FIG. 9 shows a voltage supply circuit 900 in accordance with another embodiment of the present invention. Circuit 900, which includes all the elements of and operates in a manner similar to that described above with respect to circuit 400, further includes a variable gain op-amp 902 coupled between the first output of bandgap reference voltage circuit 410 and the first input of select circuit 420. Op-amp 902, which is well-known, provides a gain of A such that a voltage equal to A*Vbg1 is provided to the first input of select circuit 420. In this manner, the trigger temperature may be adjusted by manipulating the gain A of op-amp 902.

Figure 10:
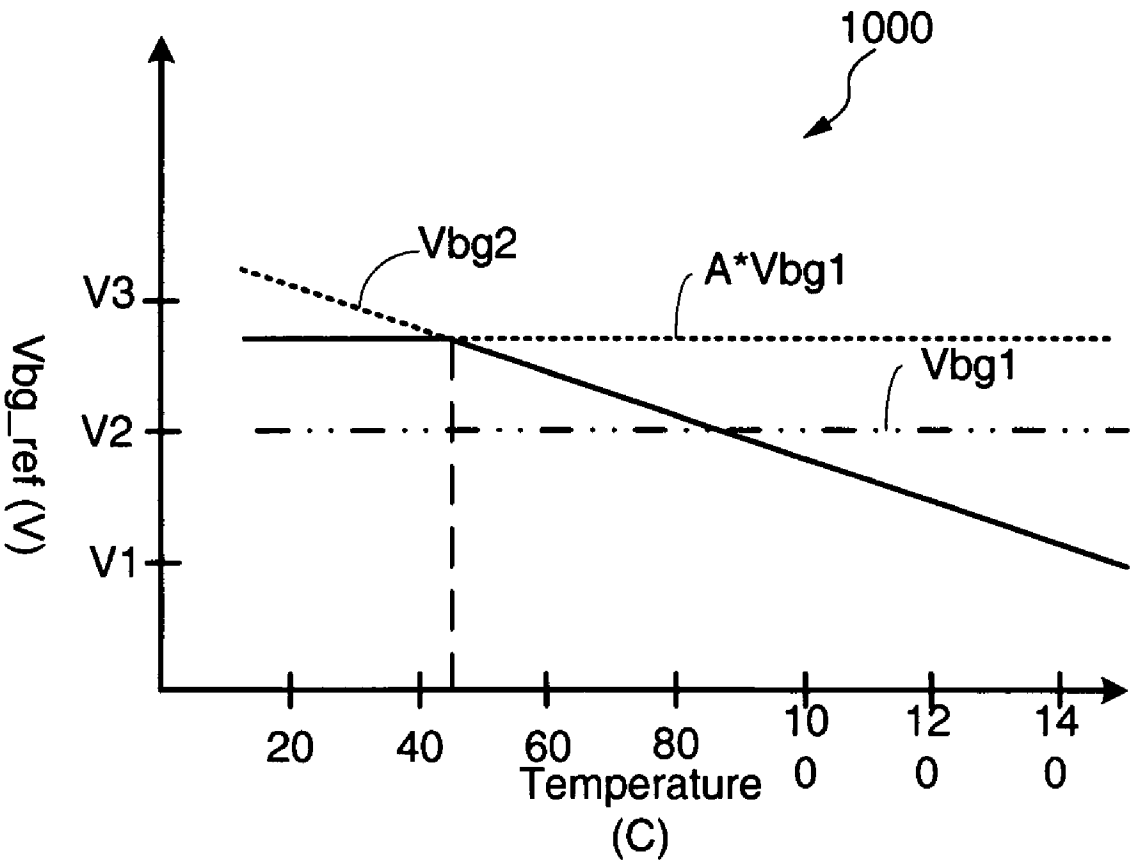
FIG. 10 is an exemplary voltage vs. temperature plot illustrating adjustment of the trigger temperature for the waveform of FIG. 8D.

For example, for embodiments in which the bandgap reference voltage circuit and the select circuit are configured to generate the Vbg_ref waveform of FIG. 8D, the trigger temperature may be decreased by providing a positive gain of A so that A*Vbg1 is greater than Vbg1. The resulting waveform 1000 is depicted in FIG. 10, which shows an exemplary value of A*Vbg1 resulting in a trigger temperature of approximately 45° C. Conversely, for other embodiments, the trigger temperature may be increased by providing a gain A of less than 1 (not shown for simplicity).

For other embodiments, op-amp 902 may be provided at the second output of bandgap reference voltage circuit 410 to provide a voltage A*Vbg2 to the second input of select circuit 420. For still other embodiments, a second op-amp (e.g., similar to op-amp 902) having an adjustable gain of B may be used to provide a voltage B*Vbg2 to the second input of select circuit 420.

While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention. For example, although the bandgap voltages are described above as having linear voltage vs. temperature relationships, for other embodiments, the bandgap voltages can have nonlinear (e.g., exponential) voltage vs. temperature relationships.

What is claimed is:

1. A voltage supply circuit for generating a composite bandgap reference voltage, comprising:

a single bandgap reference voltage circuit having a first output to generate a first bandgap voltage having a first temperature coefficient and having a second output to generate a second bandgap voltage having a second temperature coefficient that is different from the first temperature coefficient; and a select circuit having a first input to receive the first bandgap voltage, a second input to receive the second bandgap voltage, and an output to selectively provide either the first bandgap voltage or the second bandgap voltage as the composite bandgap reference voltage, wherein the select circuit comprises:

a comparator having a first input to receive the first bandgap voltage, a second input to receive the second bandgap voltage, and an output to generate a compare signal;

a control circuit having an input to receive the compare signal, a control terminal to receive a bandgap select signal, and an output; and a multiplexer (MUX) having a first input to receive the first bandgap voltage, a second input to receive the second bandgap voltage, a control terminal coupled to the output of the control circuit, and an output to provide the composite bandgap reference voltage.

2. The voltage supply circuit of claim 1, further comprising:

an op-amp coupled between the first output of the bandgap reference voltage circuit and the first input of the select circuit, the op-amp for multiplying the first bandgap voltage by an adjustable gain factor.

3. The voltage supply circuit of claim 1, wherein the select circuit selectively provides either the lesser of the first and second bandgap voltages as the composite bandgap reference voltage or provides the greater of the first and second bandgap voltages as the composite bandgap reference voltage in response to a bandgap select signal.

4. The voltage supply circuit of claim 1, further comprising a memory element to store the bandgap select signal.

5. The voltage supply circuit of claim 1, wherein the bandgap reference voltage circuit includes a resistor network comprising:

a first tap to generate the first bandgap voltage; and a second tap to generate the second bandgap voltage.

6. A voltage supply circuit for generating a composite bandgap reference voltage, comprising:

a single bandgap reference voltage circuit having a first output to generate a first bandgap voltage having a first temperature coefficient and having a second output to generate a second bandgap voltage having a second temperature coefficient that is different from the first temperature coefficient; and a select circuit having a first input to receive the first bandgap voltage, a second input to receive the second bandgap voltage, and an output to selectively provide either the first bandgap voltage or the second bandgap voltage as the composite bandgap reference voltage, wherein the bandgap reference voltage circuit comprises:

a resistor network including a series connection of first, second, and third resistors, the first resistor having a first tap to generate a first tap voltage, the second resistor having a second tap to generate a second tap voltage, and the third resistor having a third tap to generate a third tap voltage; and a switch matrix having a first input to receive the first tap voltage, a second input to receive the second tap voltage, a third input to receive the third tap voltage, a first output to provide the first bandgap voltage, a second output to provide the second bandgap voltage, and a control terminal to receive a tap select signal.

7. The voltage supply circuit of claim 6, further comprising a memory element to store the tap select signal.

8. The voltage supply circuit of claim 6, wherein the switch matrix selectively provides one of the tap voltages as the first bandgap voltage and provides another of the tap voltages as the second bandgap voltage in response to the tap select signal.

9. The voltage supply circuit of claim 6, wherein the first tap voltage has a positive temperature coefficient, the second tap voltage is relatively insensitive to temperature variations, and the third tap voltage has a negative temperature coefficient.

10. The voltage supply circuit of claim 6, wherein the bandgap reference voltage circuit further comprises:

a first PMOS transistor coupled between a voltage supply and a first terminal of the resistor network;

a fourth resistor and a first diode connected in series between a first node and ground potential, wherein the first node is coupled to a second terminal of the resistor network;

a second PMOS transistor and a fifth resistor connected in series between the voltage supply and a second node;

a second diode coupled between the second node and ground potential; and an op-amp having a first input coupled to the first node, a second input coupled to the second node, and an output coupled to a gate of the first PMOS transistor and to a gate of the second PMOS transistor.

11. A voltage Supply circuit for generating a composite bandgap reference voltage, comprising:

means for generating a plurality of tap voltages from a single resistor network, wherein each of the tap voltages has a different temperature coefficient; means for selecting one of the tap voltages as a first bandgap voltage and for selecting another of the tap voltages as a second bandgap voltage; and means for selectively providing either the first bandgap voltage or the second bandgap voltage as the composite bandgap reference voltage, wherein the means for selectively providing comprises:

means for comparing the first and second bandgap voltages to generate a compare signal; and means for selectively outputting either the first bandgap voltage or the second bandgap voltage as the composite bandgap reference voltage in response to the compare signal.

12. The voltage supply circuit of claim 11, wherein the plurality of bandgap voltages comprise:

a first tap voltage having a positive temperature coefficient;

a second tap voltage that is relatively insensitive to temperature variations; and a third tap voltage having a negative temperature coefficient.

13. The voltage supply circuit of claim 12, further comprising:

means for generating a bandgap select signal, wherein the means for selectively outputting provides the lesser of the first and second bandgap voltages as the composite bandgap reference voltage if the bandgap select signal is in a first state and provides the greater of the first and second bandgap voltages as the composite bandgap reference voltage if the bandgap select signal is in a second state.

14. A method for generating a composite bandgap reference voltage using a bandgap reference voltage circuit, the method comprising:

generating a plurality of tap voltages from a single resistor network, wherein each of the tap voltages has a different temperature coefficient;

selecting one of the tap voltages as a first bandgap voltage and for selecting another of the tap voltages as a second bandgap voltage; and selectively providing either the first bandgap voltage or the second bandgap voltage as the composite bandgap reference voltage, wherein the selectively providing comprises:

comparing the first and second bandgap voltages to generate a compare signal; and selectively outputting either the first bandgap voltage or the second bandgap voltage as the composite bandgap reference voltage in response to the compare signal.

15. The method of claim 14, wherein the plurality of bandgap voltages comprise:

a first tap voltage having a positive temperature coefficient;

a second tap voltage that is relatively insensitive to temperature variations; and a third tap voltage having a negative temperature coefficient.

16. The method of claim 15, further comprising:

generating a bandgap select signal, wherein the lesser of the first and second bandgap voltages is output as the composite bandgap reference voltage if the bandgap select signal is in a first state and the greater of the first and second bandgap voltages is output as the composite bandgap reference voltage if the bandgap select signal is in a second state.

* * * * *